United States Patent [19]

Estlick et al.

[11] 4,199,762

[45] Apr. 22, 1980

[54] PEDESTAL AND GIMBAL ASSEMBLY

[75] Inventors: Raymond J. Estlick, Winchester; Oscar E. Swenson, Concord, both of Mass.

[73] Assignee: The United States of America as represented by the Secretary of the Army, Washington, D.C.

[21] Appl. No.: 797,977

[22] Filed: May 18, 1977

[51] Int. Cl.[2] ..... H01Q 1/18

[52] U.S. Cl. ..... 343/765; 343/766

[58] Field of Search ..... 343/765, 766, 757, 758

[56] References Cited

U.S. PATENT DOCUMENTS

| | | | |
|---|---|---|---|
| 2,700,106 | 1/1955 | Taylor | 343/766 |
| 2,924,824 | 2/1960 | Lanctot et al. | 343/757 |

*Primary Examiner*—David K. Moore

*Attorney, Agent, or Firm*—Nathan Edelberg; Robert P. Gibson; Harold W. Hilton

[57] ABSTRACT

A pedestal and gimbal assembly related to missile semi-active radar seekers for supporting three gyroscopes and functions as a reference platform to relate airframe attitude. This is mechanized by utilizing the two degrees of freedom gimbal for pitch and yaw and controlling the missile body roll axis for the third degree of freedom. Structure of the positioning system includes a pedestal having an inner gimbal assembly including a support for mounting the antenna assembly and the gyros. A yaw torque motor assembly is carried by the inner gimbal and is provided with a pair of output shafts for supporting the inner gimbal and controlling the yaw movement thereof. A pitch motor is housed in the pedestal and includes a drive pinion and a drive shaft. The drive pinion is connected to the drive shaft. The drive pinion and yaw motor operates to control the pitch movement of the antenna assembly.

6 Claims, 6 Drawing Figures

PEDESTAL AND GIMBAL ASSEMBLY

DEDICATORY CLAUSE

The invention described herein was made in the course of or under a contract or subcontract thereunder with the Government and may be manufactured, used, and licensed by or for the Government for governmental purposes without the payment to use of any royalties thereon.

BACKGROUND OF THE INVENTION

This invention relates to the field of missile seeker gimbal assemblies. The basic requirements of a seeker gimbal are to provide a mechanism with the required degrees of freedom which will support the seeker antenna, slew it for target acquisition, permit target tracking, relate antenna angular positions, and provide stabilization by decoupling the antenna from missile body motions. In conjunction with the above, the mechanization should permit maximum antenna aperture while occupying minimum missile volume at a minimum weight.

SUMMARY OF THE INVENTION

The present invention provides a solution of the basic requirements by using a gimbal that is an electric drive D.C. torque motor system which gimbals the antenna/-gyros about two mutually perpendicular axes (pitch and yaw). To provide inertial stability and reduce motor torque requirements both gimbals are balanced about their respective axes.

The antenna/gyro assembly forms the inner (yaw) gimbal of the system. The antenna aperture is related to the coupling distance from the face of the antenna to its axes of rotation and this distance is dependent upon the size drive motors required to meet performance requirements. The yaw drive motor sizing is to a great extent dependent upon the yaw inertia of the inner gimbal masses. Therefore, the inner gimbal assembly is configured with gyros and balance weights located on or closely adjacent to the yaw axis to minimize yaw motor size and maximize antenna aperture.

The inner gimbal is supported on the output shafts of the yaw torque motor assembly which houses two motors. The use of two motors permits incorporation of a hollow cross shaft system through which all gimbal cabling is routed. This constrains the cables on axis to eliminate the variable unbalance torques which would result from cable service loops or flying leads. The yaw motor assembly, when mounted to the pedestal on the pitch axis shaft, becomes the pitch gimbal and is driven via a gear mesh by the pedestal mounted torque motor.

This invention may be better understood from the following detailed description taken in conjunction with the accompanying drawings.

DESCRIPTION OF THE PREFERRED EMBODIMENT

Figure 6:
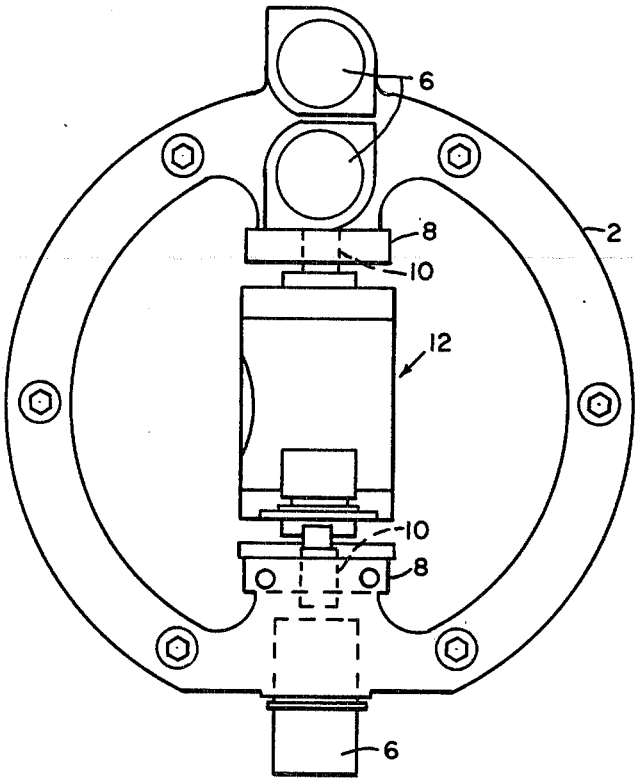
FIG. 6 is a side view of the gyro and motor support.
Figure 3:
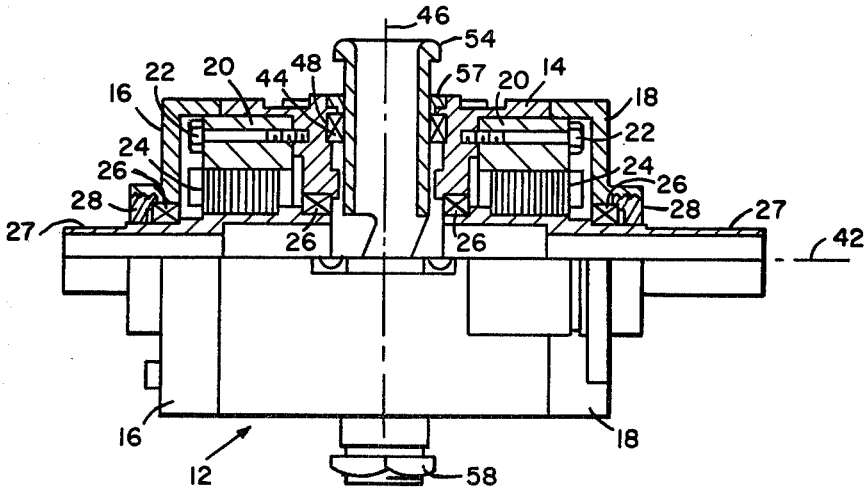
FIG. 3 is a partial section view of the yaw motor rotor assembly.

The inner gimbal includes a support casting 2, which provides mounting for the antenna assembly 4; the pitch, yaw and roll gyros 6 and gyro clamps. Balance weights 8 are set to balance the antenna about the pitch and yaw axes and also function as inner gimbal drive shaft clamps. These weights are also line bored for mounting to the yaw axis shafts 10, shown in FIG. 6. The yaw torque motor assembly 12, shown in detail in FIG. 3, includes a cast housing 14 and end caps 16, 18 which houses the components and parts required to function as the inner gimbal drive and as the outer gimbal structure. Within the torque motor assembly are two yaw motor stator and brush rigging assemblies 20 which are fastened by means 22 to the housing 14. Two yaw motor rotor assemblies 24 are supported on ball bearing 26 that are adjustably preloaded by threaded collars 28 in the end caps 16 and outwardly extending shafts 27. The end caps are fastened to the housing 14 by screws 30.

Figure 4:
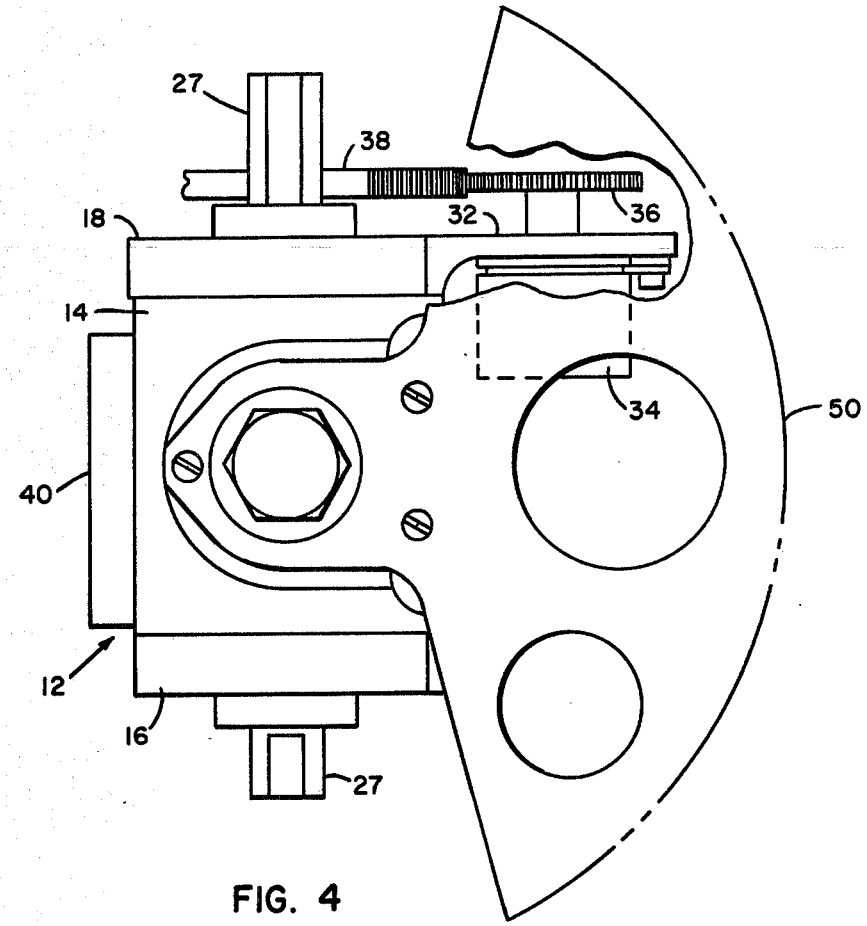
FIG. 4 is a side view with one sector gear cut away.
Figure 5:
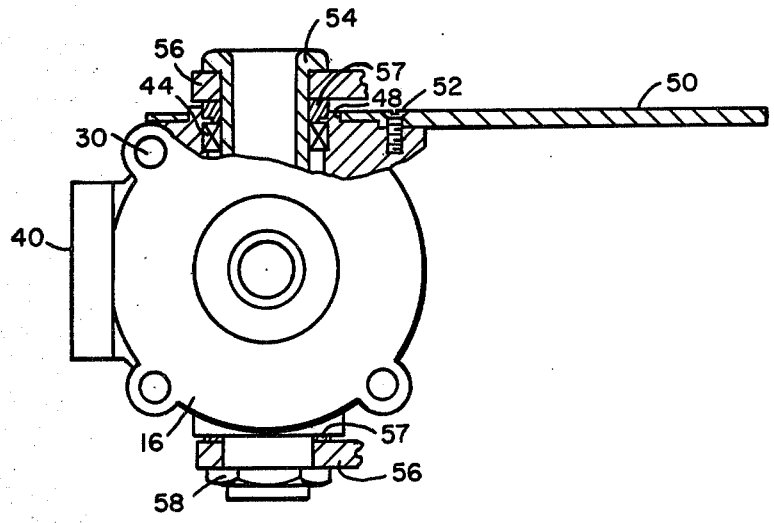
FIG. 5 is a further partial section of the yaw motor rotor assembly.

End cap 18 has an extended arm 32, shown in FIG. 4, for mounting the yaw potentiometer 34 that has an anti-backlash gear 36 which engages a sector gear 38 mounted on the inner gimbal. A balance weight 40 is mounted on the forward face of housing 14. The housing 14 is line bored perpendicular to the yaw axis 42 to accept the pitch axis bearing 44. Reference numeral 46 identifies the pitch axis. A concentric pilot diameter 48 is machined to position the pitch sector gear 50 which is thus pivoted on axis 46 and fastened to the side of housing 14 by fasteners 52. When installed on the pitch shaft 54 within the pitch pedestal 56 the assembly becomes the pitch gimbal. Spacers 57 are placed between the pitch bearing inner races 44 and pedestal 56 to provide required pitch axis bearing preload.

Figure 1:
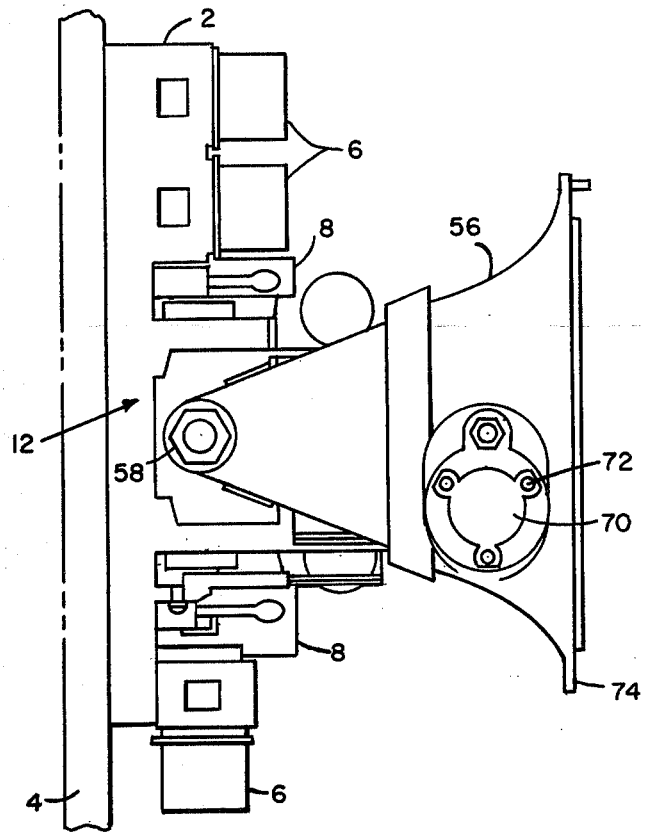
FIG. 1 is a side view of the assembly.
Figure 2:
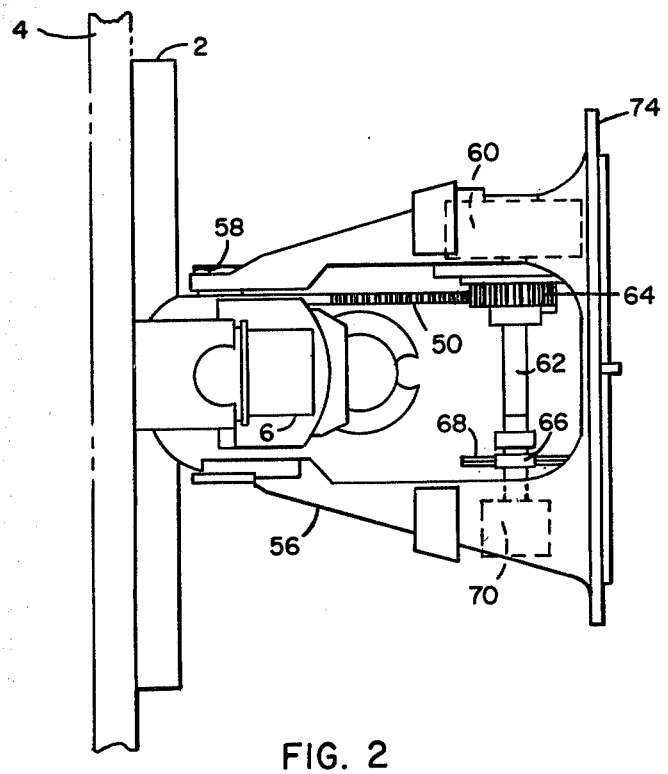
FIG. 2 is another side view of the assembly 90° to FIG. 1.

As seen in FIG. 2, the pedestal 56 houses a pitch motor 60 that has its stator brush rigging connected to the pedestal and its rotor connected to the pitch axis drive shaft 62 that is supported in the pedestal. A pitch axis drive pinion 64 is fastened to the pitch axis drive shaft and engages the pitch sector gear 50. The drive shaft 62 also has a pitch potentiometer drive pinion 66 connected thereto and engages the anti-backlash gear 68 on the output shaft of the pitch potentiometer 70. The pitch potentiometer is secured to the pedestal by clamps 72 and the pedestal is provided with a flange 74 for mounting to the missile structure.

During the pre-launch phase of operation, the inner gimbal mounted potentiometers provide antenna position information. The potentiometers' electrical outputs, representing the actual gimbal angle, are electrically compared to the corresponding system input signal that defines the desired gimbal position. The resulting difference signal is applied as a correction signal to the input of a rate stabilization loop which causes the properly phased head motion to force the error signal to zero by means of the torque motor drives.

After pre-launch, the antenna position is controlled relative to the inertial attitude sensed by the antenna mounted rate integrating gyros. Each of the gyros provides an output signal that represents the algebraic difference between the integrated mechanical rate sensed about its input axis and the electrical command signal is applied to its torquer. The gyro error signal represents the difference between the desired and actual inertial attitude of the antenna. By closing a feedback loop through each gyro and its associated gimbal mounted torque motor to drive the gimbals in proportion to the error magnitude, the inertial attitude is established and maintained.

In each gimbal axis, torque developed by the motor rotates the gimbal structure via the motor pinion and gimbal gear. Gimbal motion is then imparted to the potentiometer from the gimbal mounted gear to the potentiometer gear.

Such control systems are known in the art and are similar to the systems disclosed in the U.S. Pat. No. 2,915,688 issued to Edward H. Wilde on Dec. 1, 1959 entitled "Digital to Analog Servosystem" also in the U.S. Pat. No. 2,660,793 issued to C. G. Holschuk et al on Dec. 1, 1953, entitled "Stabilized Tracking and Fire Control System".

We claim:

1. In an antenna positioning system, a pedestal and gimbal assembly for supporting components of the system including an antenna assembly and three gyros comprising: a pedestal; an inner gimbal assembly including a support for mounting said antenna assembly and said gyros; a yaw torque motor assembly carried by said inner gimbal and having a pair of hollow output shafts for supporting said inner gimbal and controlling the yaw movement therefor; a pitch motor housed in said pedestal and having a drive pinion and a drive shaft, said drive pinion connected to said drive shaft; and, means connected between said drive pinion and said yaw motor assembly for controlling the pitch movement of said antenna assembly.

2. An assembly as set forth in claim 1 wherein said yaw torque motor assembly includes a cast housing and a pair of motor stator bush riggings attached to said cast housing and adjustable preloaded ball bearings for supporting said output shafts.

3. An assembly as set forth in claim 2 wherein said cast housing is provided with a pitch shaft perpendicular to the yaw axis and bearing to support the pitch shaft, said pitch shaft and said yaw motor output shafts being hollow.

4. An assembly as set forth in claim 3 wherein said cast housing is further provided with a weight for pitch balancing of said housing.

5. An assembly as set forth in claim 4 wherein said pedestal is provided with a pitch potentiometer having an anti-backlash gear attached to its output shaft, said pitch motor drive shaft having a second drive pinion for engagement with said anti-backlash gear.

6. An assembly as set forth in claim 5 wherein a pitch sector gear is attached to said cast housing and is connected to the first drive pinion for movement thereby to control the pitch movement of the antenna assembly.

* * * * *